United States Patent [19]

Drescher

[11] 4,117,785

[45] Oct. 3, 1978

[54] SAFE WITH RECESSED DIAL

[75] Inventor: Erwin Drescher, Melsungen, Fed. Rep. of Germany

[73] Assignee: Melsunger Metall-Werk, Erwin Drescher, Melsungen, Fed. Rep. of Germany

[21] Appl. No.: 791,390

[22] Filed: Apr. 27, 1977

[30] Foreign Application Priority Data

Feb. 11, 1977 [DE] Fed. Rep. of Germany ..... 2705711

[51] Int. Cl.[2] ..... E05G 1/04

[52] U.S. Cl. ..... 109/59 T; 70/289

[58] Field of Search ..... 109/58, 59, 61, 64; 70/289

[56] References Cited

U.S. PATENT DOCUMENTS

| | | | |
|---|---|---|---|
| 378,568 | 2/1888 | Baumann | 70/289 |
| 1,369,521 | 2/1921 | de Curtis | 70/289 |
| 1,838,581 | 12/1931 | Sioberg | 109/59 |

*Primary Examiner*—Mervin Stein

*Assistant Examiner*—David H. Corbin

*Attorney, Agent, or Firm*—Max Fogiel

[57] ABSTRACT

A safe with a safe door and a recessed dial which is constructed to actuate the safe lock and to release the blocking of the bolt system. The recessed dial can be pulled forward from the safe door in its axial direction. A bolt actuated by the dial is provided for blocking or releasing the forward movement in such a way, that the dial can be pulled forward only when the lock is in open position and the dial can simultaneously actuate the bolt system. The dial is held axially captive in the safe door, and a stop is provided for limiting the pull-forward movement. An axially displaceable clutch is installed on the shaft of the dial and has two telescoped pipe sections of polygon cross-section. One section of the clutch has on its outer periphery a curved track which serves for force-linked support of the bolt system in all positions. The bolt for blocking or releasing the pull-out movement of the dial is in the form of a bolt plate located at the lock and is rigidly connected to the lock bolt.

11 Claims, 3 Drawing Figures

SAFE WITH RECESSED DIAL

BACKGROUND OF THE INVENTION

The present invention relates to a safe or similar container, etc. with a safe door and a recessed dial. The dial is constructed to actuate the lock and to release the blocking of the bolting system.

Such a safe is already known in the art. In addition to the recessed dial, there is a recessed handwheel. After releasing the blocking by the dial, the handwheel can be pulled from its recessed position by a certain amount so that it can be rotated easier in order to move the lock bars and to pull open the door of the safe. This construction has the disadvantage that the safe door must have two openings of relatively large diameters, one for the dial and one for the handwheel. The dial always remains in its recessed position. Pulling the door open by means of the dial is not possible.

There are also known safes with number combination locks having a dial where the dial knob projects beyond the front side of the door. The dial knob and other parts of the dial or a dial scale project forward from the door surface so that they interfere with the camouflaging of the safe, e.g., by a painting hung over the safe door in the case of a wall safe. To apply force to the dial knob of the dial, only the dial knob itself is available and it has a relatively small application surface. This is sufficient for dial movements, but cumbersome and inadequate with a heavy safe door.

With smaller safes, it also is known how to actuate the bolt system and the lock by the dial alone. Here the abovedescribed disadvantage of operation occur. With larger safes, the dial is only used to actuate the lock and to release the blocking of the movement of the bolt system. The bolt system itself is actuated via a handwheel or a handle etc.

It is, therefore, an object of the present invention to provide a safe with recessed dial which no longer has the disadvantages described. Even with heavy safes, the entire operation, i.e., opening and closing of the safe door, should be possible by means of one element. This requires, above all, that for actuating the bolt system and for pulling open the door, a sufficiently large surface area with corresponding active radius for rotary movements is available to the bolt system.

Another object of the present invention is to provide a safe with a recessed dial of the foregoing character, which is simple in construction and may be economically fabricated.

A further object of the present invention is to provide a safe arrangement, as described, which may be readily maintained in service and which has a substantially long operating life.

SUMMARY OF THE INVENTION

The objects of the present invention are achieved by providing that the recessed dial can be pulled forward in the direction of its axis from the safe door. A bolt actuated by the dial is provided for blocking or releasing the pull-forward movement. It is arranged in such a way that the dial can be pulled forward only with the lock open and that the dial can simultaneously actuate the bolt system. Thus the dial functions simultaneously as a handwheel, and the arrangement that in the pulled-forward position where not only the small surface radius of the dial knob on the dial, but also its largest outside diameter is available. Hence the force required for actuating the bolt system can easily be found. For pulling the door open, a sufficiently large contact surface is accessible to the hand on the outside diameter of the dial so that this process can also be implemented easily and conveniently. As long as the lock is still locked, the dial cannot be pulled from its recessed position so that this single opening in the safe door, with the door locked, is additionally secured by the presence of the dial in the opening. Of course, the dial can be moved in its axial direction during the pull-out movement; during this movement, the rotary link is not interrupted, i.e., a rotary movement continues to be transmitted from the dial to the lock or the bolt system even in the pulled-out condition.

The dial is held axially captive in the safe door. A stop is provided for limiting the pull-out movement. This stop simultaneously serves to transmit the force when pulling the safe door open.

An axially displaceable clutch, ensuring rotation, is installed on the shaft of the dial, hence between dial and lock. Various possibilities present themselves to the technical expert for designing this clutch. The clutch may comprise two telescoped tubular sections of polygon cross-section.

In a further development of the invention, one of the two clutch sections, e.g., the tubular socket, has on its outer periphery a curved track which serves for force-linked support of the bolt system on the dial in all positions. Hence, the bolt system is supported in a force-linked manner. It is connected to the dial not only via the relatively underdimensioned portions of the lock.

The bolt for blocking or releasing the pull-out movement of the dial in a preferred embodiment, comprises a bolt plate which is located at the lock and is rigidly connected to the lock bolt, while in the clutch portion associated with the dial a peripheral groove, a shoulder, etc. is provided. This blocking does not prevent rotation of the dial, but only an axial pull-out movement. Only when the lock has been set at least partially to the open position, is this blocking released so that the dial can be pulled out to actuate the bolt system.

The door opening, required for recessed installation of the dial, on the door's inside is covered by a door plate which has the wall thickness of the door. This door plate must only have a relatively small opening to pass the shaft of the dial or parts of the axial clutch.

The lock bolt is connected to the bolt plate of the bolt and to the traverse (crosstie rod) for the individual bolts.

For force-locked support of the bolt system by the curved track, the bolt plate has a support block rigidly connected to it. This support block can be inserted in a fold in the bolt plate and have a height such that the curved track, even with the lock bolted, is in contact with the support block with an angular position of the dial.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
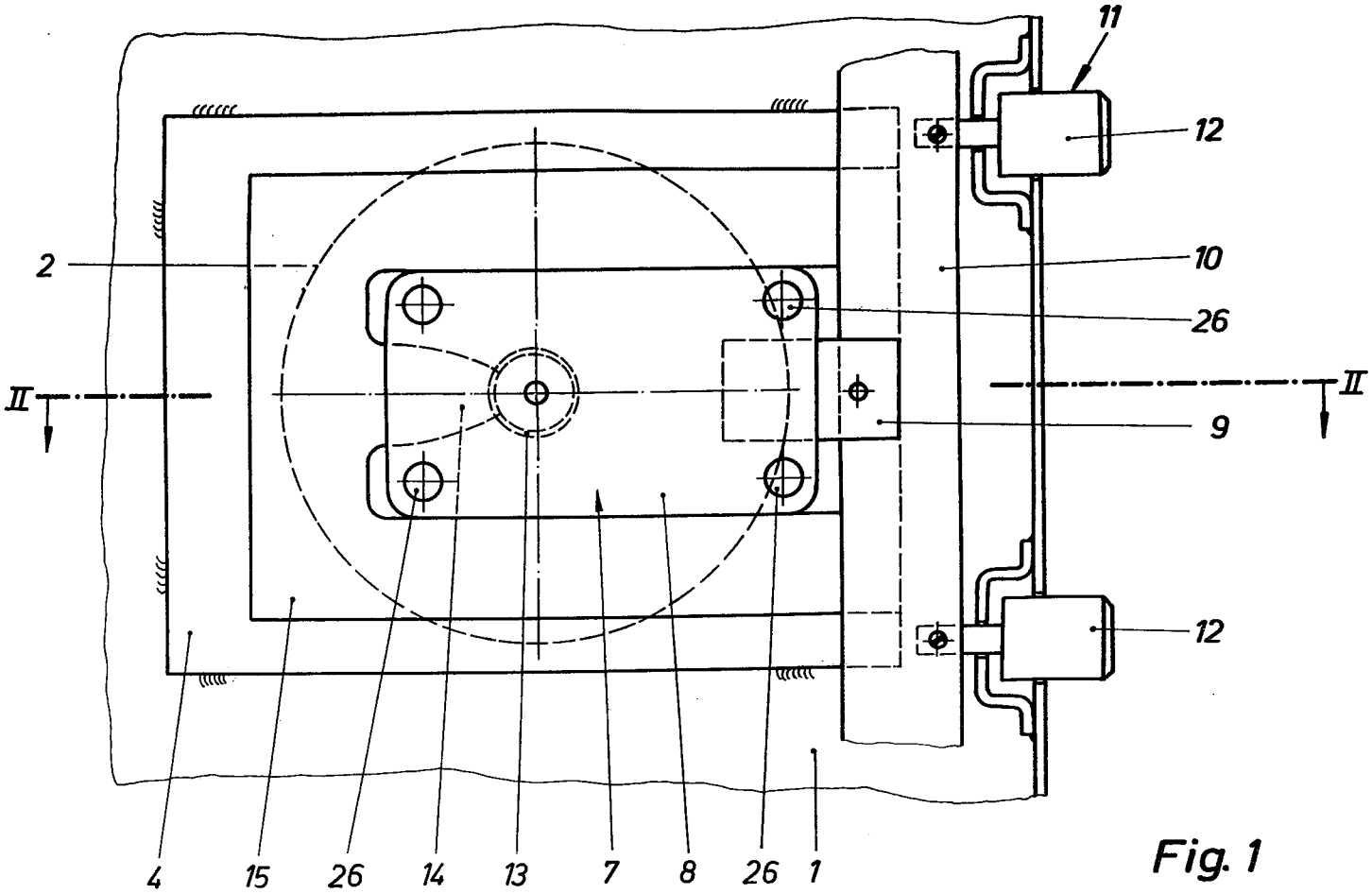
FIG. 1 shows a view from the inside of the safe door onto the portion holding the lock.

FIG. 1 shows a portion of the safe door 1, seen from the inside of the safe. A dial 2 is recessed in this safe door 1. The opening 3 in the safe door 1, required for recessed installation of dial 1, is covered by door plate 4. The door plate 4 has the same wall thickness as the safe door 1 and is welded to it. The door plate 4 has a drill hole 5 to pass a shaft 6 which serves to actuate lock 7. Lock 7 is known in the art. Therefore, for the sake of simplicity only lock housing 8 is shown.

Lock 7 comprises lock bolt 9 to which the traverse 10 of the bolt system 11 is connected. The individual bolts 12 are connected to crosstie rod 12. The individual bolts 12 serve to secure the door in the door frame in the conventional manner.

Figure 2:
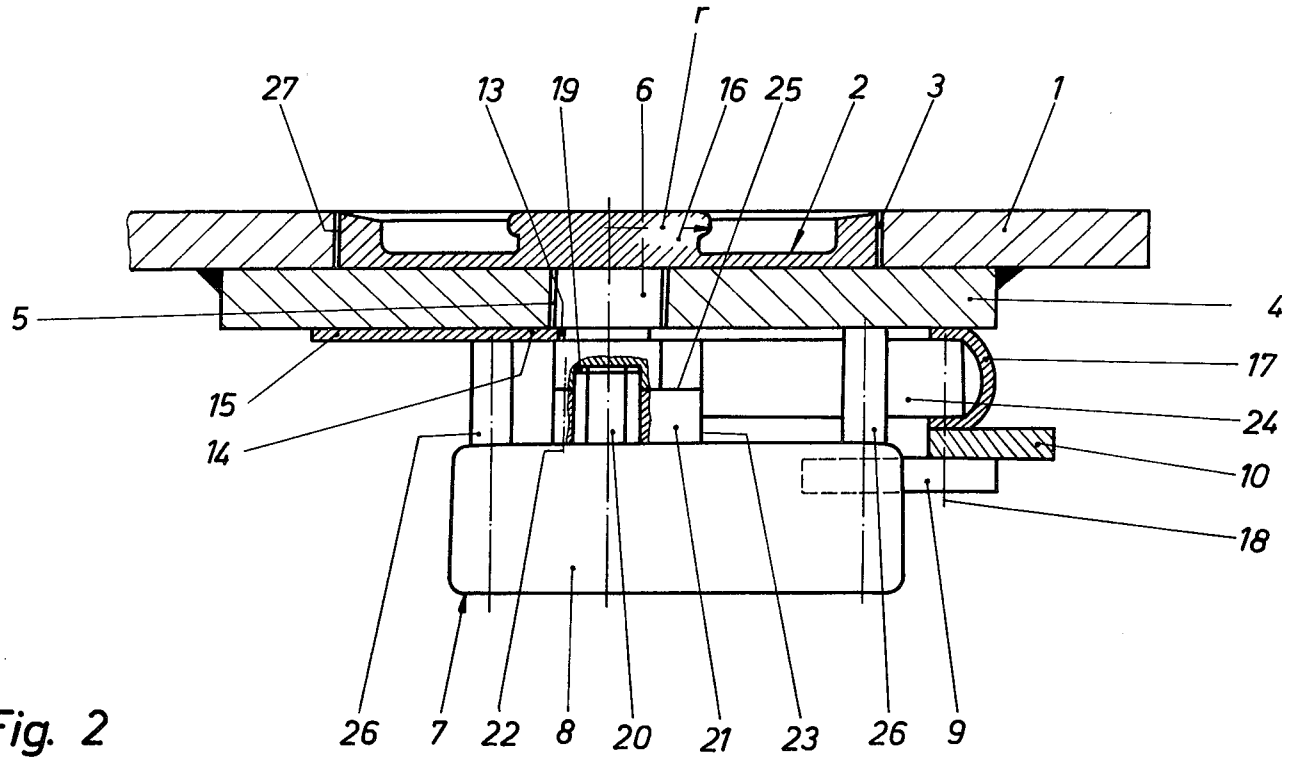
FIG. 2 shows a cross-section taken along line II-II in FIG. 1 through the safe door in the lock area with the lock bolted.
Figure 3:
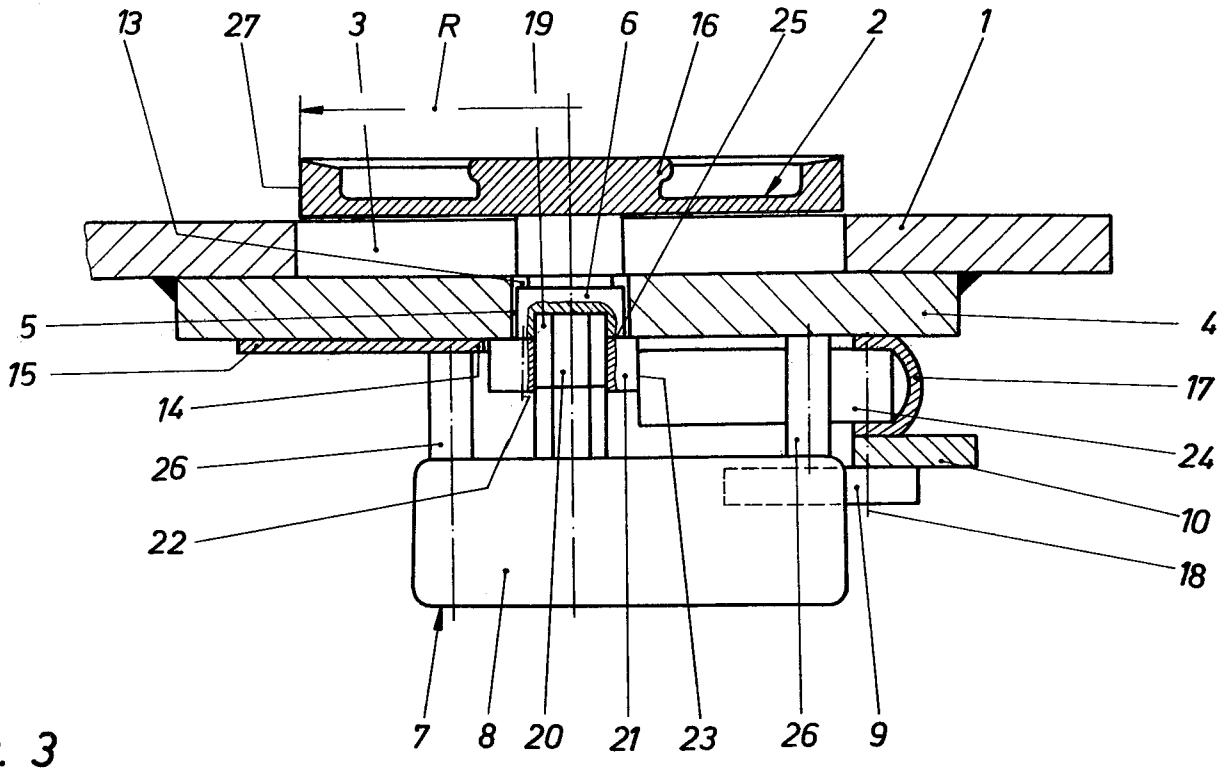
FIG. 3 a similar section as FIG. 2, but with the lock open and the dial pulled forward.

The shaft 6 which passes through the door plate 4 has a peripheral groove, a shoulder, etc. 13 which engages the bolt 14 of a bolt plate 15 when the lock 7 is bolted. This makes possible rotation of dial 2, but not an axial pull-forward. To rotate the dial, force is applied to the dial knob 16 which has radius r. The bolt plate 15 with bolt 14 can be shifted in door plate 4, as shown in FIGS. 2 and 3. The bolt plate 15 has a fold 17 and is rigidly connected to the crosstie rod 10 and the lock bolt 9 of lock 7. The rigid connection is ensured by a pin 18. It may also be welded on.

The shaft 6 has a recess 19 of hexagonal cross-section which may be open on the side facing the lock. Into this recess 19, there projects a stubshaft 20 which also has a hexagonal cross-section. Of course, a different polygon cross-section may also be used. The important thing is that the rotary connection is ensured while an axial movement of these parts is permitted. Shaft 6 and stubshaft 20 which engages the lock constitute a clutch 6, 20. The stubshaft 20 may have a different useful cross-section on its portion projecting into the lock housing 8.

Shaft 6 holds a support disk 21 which is connected to shaft 6 by means of several screws 22. The recess 19 of shaft 6 continues in the area of the support disk 21. On its outer periphery, support disk 21 has a curved track 23 which contacts a support block 24 at a certain angular position of the dial 2.

This applies as long as the lock is bolted. When the lock is unbolted, there is continuous contact of support disk 21 with support block or vice versa, as long as the bolt system 11 is actuated. The support block 24 is rigidly connected to the bolt plate 15 and the crosstie rod 10 of the bolt system 11, for example, by the through-going (continuous) pin 18.

On its face side facing the dial 2, the support disk 21 has a stop 25 which restricts the pull-forward movement of dial 2 when stop 25 contacts door plate 4.

The lock 7 is fastened to the door plate 4 by means of screws and sleeves 26.

The dial 2 comprises not only the dial head 16 of relatively small radius r, but also has a relatively large outside rim 27 of radius R. Knurling may be placed on the outside rim 27.

In operation, FIG. 2 shows the closed position of the safe or the safe door. The bolt 14 of the bolt plate 15 engages the peripheral groove 13 so that the dial 2 is held in its recessed position. It can only be turned, by applying a force to the dial knob 16 of dial 2. The required turns are made to bring the lock to the open position. The turns are transmitted to the lock via the clutch 6, 20.

If the start of the open position of lock 7 is reached, the lock bolt 19 moves by a certain amount into the lock housing 8, taking along the crosstie rod 10 and the bolt plate 15 so that finally the bolt 14 is pulled out from the peripheral groove 13. The curved track 23 during all this time is in contact with the support block 24. The arrangement may also be such that first only the bolt plate 15 with bolt 14 is moved and only during the opening movement the crosstie rod 10 is dragged along. This can be achieved, e.g., by oblong-hole pivoting of the crosstie rod 10 to the lock bolt 9.

As soon as the peripheral groove 13 is released, i.e., with the bolt system 11 still locked, the blocking of the pull-out movement of the dial 2 is released. By turning the dial knob 16, the dial 2 is pulled forward to the position shown in FIG. 3 so that now a force can be applied to the outside rim 27 with the large radius R. Now it is easily possible to further rotate the dial 2 which now acts as a handwheel, in order to actuate bolt system 11 and to pull the individual bolts 12 from the recesses in the door frame in their entirety so that the safe door is free to open. At the end of the actuation of bolt system 11, the safe door 1 can be pulled open so that the safe becomes accessible.

The operation during the closing of the safe door runs the opposite way. After actuating the bolt system 11 or at the end of this movement, the dial 2 is pushed axially back into the opening 3, providing the bolt 14 of bolt plate 15 the opportunity to engage the peripheral groove 13 and to block the axial pull-out of the dial 2.

It is understood that during the entire time of actuating the bolt system 11, there is continuous support of the parts of bolt system 11 via the crosstie rod 10, the support block 24 and the curved track 23 of the support disk 21 by the mounting of dial 2 in the door plate 4. The curved track 23 is shaped in accordance with this sequence of movements. This is of advantage since the forces need not be transmitted via the comparatively underdimensioned parts of lock 7.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What is claimed is:

1. A safe with a safe door; a recessed dial in said door, a lock and a bolt system connected to said recessed dial; said recessed dial having a first portion movable for actuating said lock to an open position; means connected to said lock for releasing said bolt system from a blocked state when said lock has been actuated to the open position; means connecting said recessed dial to said lock for actuating said lock to said open position when said recessed dial is moved to a predetermined position corresponding to the open position of said lock; auxiliary bolt means connected to said lock and having means engaging said recessed dial, said recessed dial having forward and retracted positions, means connecting said lock and said auxiliary bolt means for disengaging said auxiliary bolt means from said recessed dial when said lock has been actuated to said open position; means connecting said lock and said bolt system for releasing said bolt system when said lock is in said open position; means mounting said recessed dial, said recessed dial being movable forward from said safe door in an axial direction of said dial after said auxiliary bolt means has been disengaged from said recessed dial by said lock, said recessed dial being movable in axial direction of said mounting means to the forward position from retracted position, said engaging means of said auxiliary bolt means engaging said recessed dial for inhibiting movement of said recessed dial to the forward position from the retracted position when said lock is in locked position; said auxiliary bolt means engaging said recessed dial when said lock is in locked position; said dial having a second movable portion; means connecting said dial to said bolt system for actuating said bolt system to an open position in said forward position of said dial by moving said second movable portion.

2. The safe as defined in claim 1 including a stop for limiting said forward movement, said dial being held axially captive in said safe door.

3. The safe as defined in claim 1 including a shaft connected to said dial; and an axially displaceable clutch on said shaft.

4. The safe as defined in claim 3 wherein said clutch comprises two telescoped pipe sections of polygon cross-section.

5. The safe as defined in claim 1 wherein said clutch has two sections, one of said clutch sections comprising a tubular socket having on its outer periphery a curved track for force-linked support of said bolt system in all positions.

6. The safe as defined in claim 1 wherein said auxiliary bolt means comprises a bolt plate located at the lock and rigidly connected to said lock bolt, said clutch having a portion associated with said dial and having a peripheral groove.

7. The safe as defined in claim 1 including a door plate; said door having a recessed opening for receiving said dial, said recessed opening being covered on the inside of said safe door by said door plate.

8. The safe as defined in claim 1 including a lock bolt; said bolt for locking or releasing the forward movement of said dial having a bolt plate connected to said lock bolt; individual bolts; and a crosstie rod for said individual bolts, said lock bolt being also connected to said crosstie rod.

9. The safe as defined in claim 5 including a bolt plate with a support block rigidly connected thereto for force-locked support of said bolt system on said curved track.

10. The safe as defined in claim 9 wherein said bolt plate has a fold for insertion of said support block.

11. A safe with a safe door as defined in claim 1 including a stop for limiting said forward movement, said dial being held axially captive in said safe door; said first portion of said dial comprising a substantially circular-shaped element having a predetermined radius, said second portion of said dial comprising a substantially circular-shaped portion having a predetermined radius substantially greater than the radius of said first portion, said radius of said first portion being manually gripped for locating said dial and actuating said lock for releasing said bolt system and said auxiliary bolt means, said second portion of said dial being gripped manually to actuate said bolt system, the actuation of said bolt system requiring substantially greater force than actuation of said lock; a shaft connected to said dial, and an axially displaceable clutch on said shaft; said clutch having two sections, one of said clutch sections comprising a tubular socket having on its outer periphery a curved track for force-linked support of said bolt system in all positions; a door plate; said door having a recessed opening for receiving said dial, said recessed opening being covered on the inside of said safe door by said door plate; on said engaging means; said auxiliary bolt means for locking or releasing the forward movement of said dial having a bolt plate connected to said lock bolt; individual bolts; and a cross tie rod for said individual bolts, said lock bolt being also connected to said cross tie rod; a support block connected to said bolt plate for force locked support of said bolt system on said curved track; said bolt plate having a fold for insertion of said support block.

* * * * *